United States Patent [19]

Cotton et al.

[11] Patent Number: 4,993,465

[45] Date of Patent: Feb. 19, 1991

[54] ROUTER TOOL FOR AND METHOD OF PRODUCING WORKPIECES WITH ALTERNATING CONTOUR MATING SURFACES

[75] Inventors: Lawrence M. Cotton; Gary R. Compton, both of New Bern, N.C.

[73] Assignee: Robert Bosch GmbH, Stuttgart, Fed. Rep. of Germany

[21] Appl. No.: 445,745

[22] Filed: Dec. 4, 1989

[51] Int. Cl.[5] ..... B27M 1/00

[52] U.S. Cl. ..... 144/371; 144/218; 144/240; 407/54; 407/61

[58] Field of Search ..... 408/230, 229, 227; 409/132, 137, 182; 407/53, 54, 61, 116; 144/134 D, 136 C, 218, 240, 90 R, 90 A, 91

[56] References Cited

U.S. PATENT DOCUMENTS

| | | | |
|---|---|---|---|
| 846,666 | 3/1907 | Hanson | 144/240 |
| 3,548,476 | 12/1970 | Cave et al. | 407/54 |
| 4,860,809 | 8/1989 | Cotton et al. | 144/134 D |

FOREIGN PATENT DOCUMENTS

| | | | |
|---|---|---|---|
| 27338 | 3/1921 | Denmark | 144/240 |

*Primary Examiner*—W. Donald Bray
*Attorney, Agent, or Firm*—Michael J. Striker

[57] ABSTRACT

Workpieces with alternating contour mating surfaces are produced by a routing tool comprising a working portion having an axis and an outer contour shaped so that in an axial cross-section of the working portion the outer contour includes a plurality of straight lines arranged in a consecutive order and each extending in a direction substantially along the axis.

12 Claims, 4 Drawing Sheets

FIG. 1
PRIOR ART
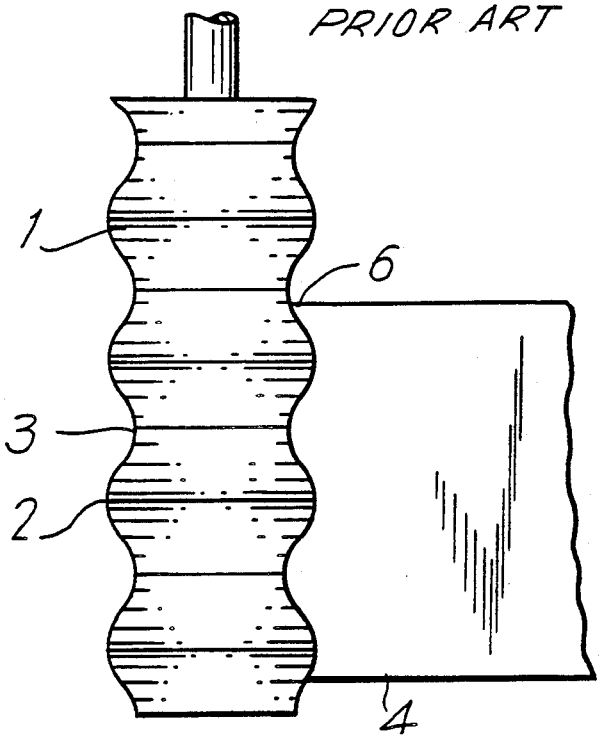
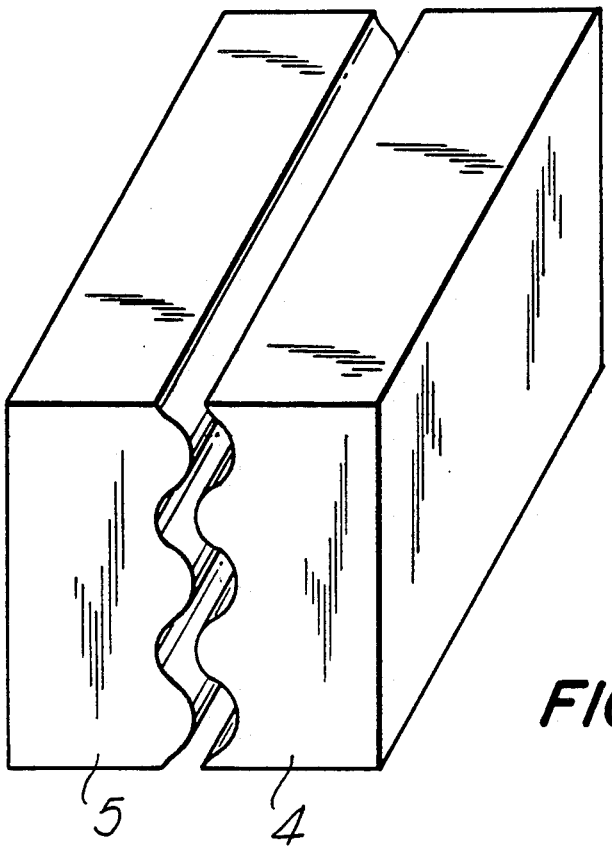
FIG. 2

ROUTER TOOL FOR AND METHOD OF PRODUCING WORKPIECES WITH ALTERNATING CONTOUR MATING SURFACES

BACKGROUND OF THE INVENTION

The present invention relates to a router tool for and a method of producing workpieces with alternating contour mating surfaces.

Router tools and methods of the above general type are known in the art. Our U.S. Pat. No. 4,860,809 discloses a method of and a device for producing such alternating contour mating surfaces. FIG. 2*a* of the above mentioned patent shows a router tool for producing such mating surfaces, which routing tool has an alternating contour formed by alternating concave and convex curved surfaces While it is true that with such a router tool the alternating contour mating surfaces can be produced, it possesses several disadvantages. When the alternating contour of router tool 1 is formed by alternating curved surfaces 2 and 3, the routed surface of workpieces 4 and 5 can have a chippable, brittle feather edge 6, as shown in FIGS. 1 and 2. For routing the workpieces, the adjustment of the router tool to provide its desired protrusion in an axial direction is critical, and therefore there is a risk of misalignment of the router tool.

SUMMARY OF THE INVENTION

Accordingly, it is an object of the present invention to provide a router tool for and a device of producing workpieces with alternating contour mating surfaces, which avoid the disadvantages of the prior art.

More particularly, it is an object of the present invention to provide a router tool for and a method of producing workpieces with alternating contour mating surfaces, which are capable of producing workpieces without brittle edges and in which vertical adjustment of the router tool along its axis is no longer critical.

In keeping with these objects and with others which will become apparent hereinafter, one feature of the present invention resides, briefly stated, in a router tool with a working portion having an axis and an outer contour shaped so that in an axial cross-section of the working portion the outer contour includes a plurality of straight lines arranged in a consecutive order and each extending in a direction substantially along the axis.

Another feature of the present invention is a method of producing workpieces with alternating contour mating surfaces which involves the steps of routing of work-pieces with a routing tool comprising a working portion having an axis and an outer contour shaped so that in an axial cross-section of the working portion the outer contour includes a plurality of straight lines arranged in a consecutive order and each extending in a direction substantially along the axis so as to form with the axis an angle of at most 20°.

When the router tool is designed and the method is performed in accordance with the present invention, no chippable, brittle feather edge is produced during routing of the workpieces Also, the adjustment of the router tool in the axial direction is not as critical, especially when in an advantageous embodiment of the present invention, the straight lines of the outer contour of the working portion of the tool extend parallel to the axis of the tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a router tool for producing workpieces with alternating contour mating surfaces in accordance with the prior art;

FIG. 2 is a view showing two workpieces with alternating contour mating surfaces produced with the prior art router tool;

DESCRIPTION OF THE PREFERRED EMBODIMENTS

Figure 3:
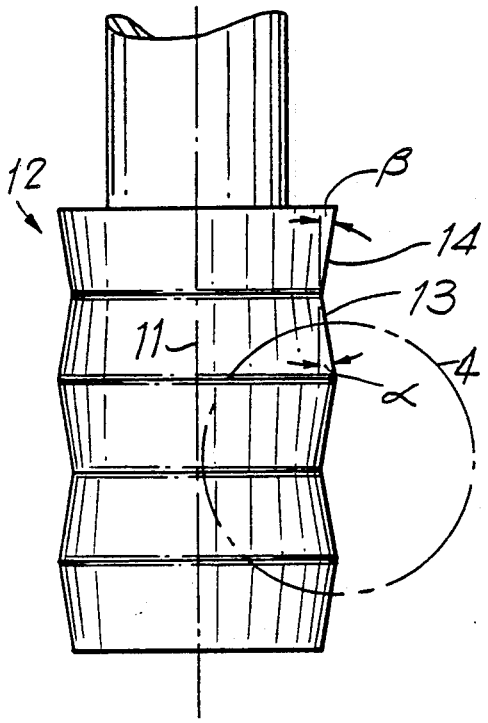
FIG. 3 is a view showing a router tool for producing workpieces with alternating contour mating surfaces in accordance with the present invention.

A router tool (a router bit) in accordance with one embodiment of the present invention is shown in FIG. 3. It has a working portion which is identified as a whole with reference numeral 10. The working portion 10 is a rotation-symmetrical body and has an axis 11. The working portion has an alternating outer contour identified as a whole with reference numeral 12. The outer contour 12 of the working portion 10 is shaped so that in an axial cross-section of the working portion shown in FIG. 3, the outer contour 12 includes a plurality of straight lines arranged in a consecutive order and extending in a direction substantially along the axis 11.

Figure 4:
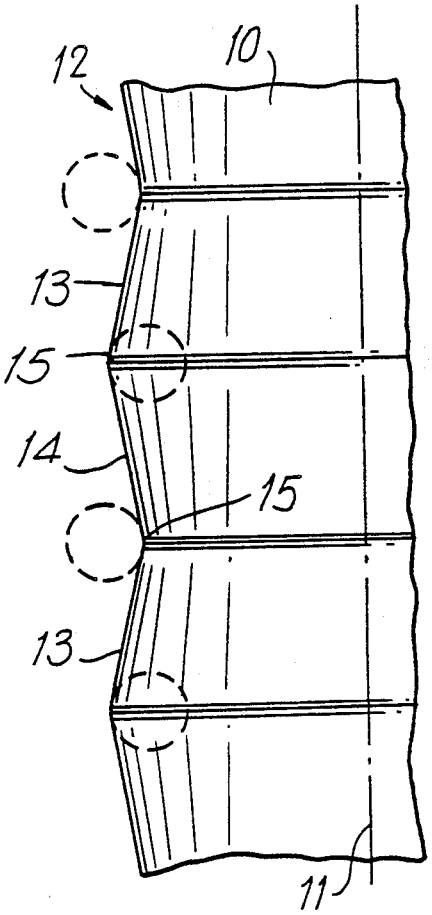
FIG. 4 is an enlarged view of a fragment 4 of the router tool of FIG. 3.

In the embodiment of FIGS. 3 and 4, the straight lines of the outer contour 12 of the working portion 10 are inclined relative to the axis 11 at small angles and so that they are inclined toward the axis and away from the axis in an alternating order. The angles of inclination of two neighboring inclined straight lines 13 and 14 identified as $\alpha$ and $\beta$ are small, and preferably do not exceed 20°.

As can be seen from FIG. 4, the outer contour 12 of the working portion 10 of the inventive router tool also includes a plurality of connecting lines identified with reference numeral 15. In this embodiment the connecting lines 15 are formed as curved lines, preferably with the shape of circular arcs.

Figure 5:
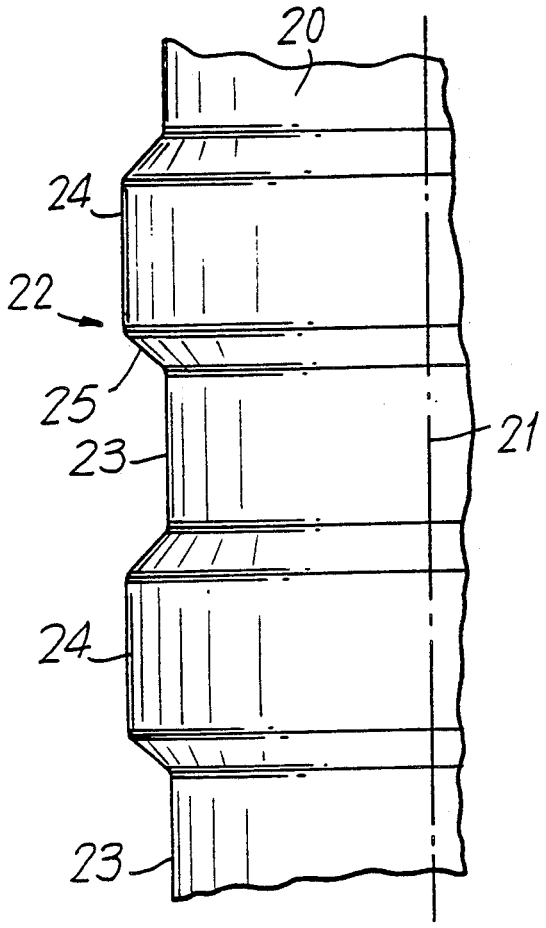
FIGS. 5 and 6 are views showing fragments of a router tool in accordance with two further embodiments of the present invention.

The router, tool of FIG. 5 has an outer contour 22 with a plurality of straight lines 23 and 24 which extend parallel to an axis 21 of a working portion 20 of the tool. The straight lines 23 and 24 are offset relative to one another in a direction transverse to the axis 21 so that the straight lines 23 are located close to the axis 21 and the straight lines 24 are located farther from the axis 21. The straight lines 23 and 24 are connected with one another by connecting lines 25. The connecting lines 25 are formed as straight lines which are inclined relative to the straight lines 23 and 24 and relative to the axis 21 of the working portion. It is to be understood that in the practical application, the opposite ends of each connecting line 25 can merge into the straight lines 23 and 24 through curves with a very small radius.

Figure 6:
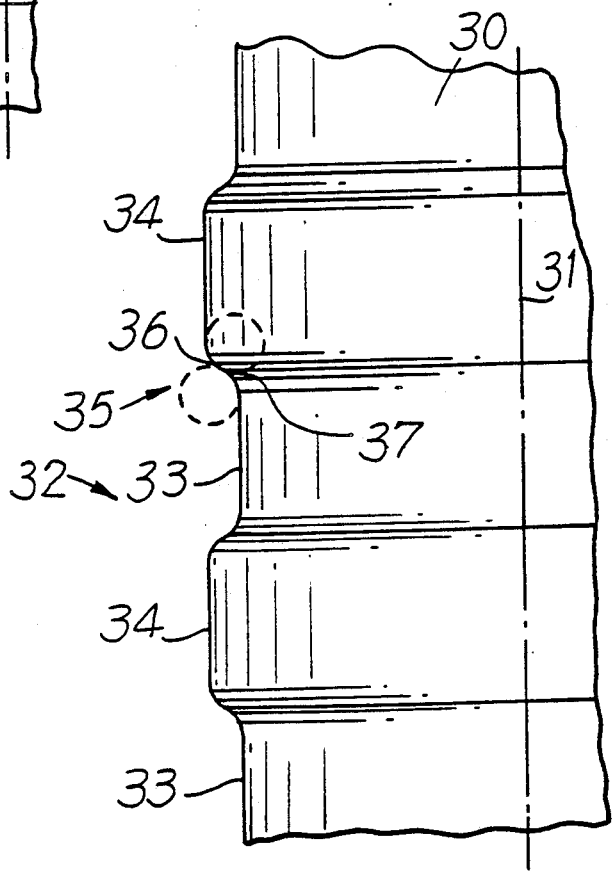

A router tool in accordance with the embodiment of FIG. 6 has a working portion 30 with an outer contour 32 which also includes alternating straight lines 33 and 34 extending parallel to the axis 31. The straight lines 33 and 34 are connected with one another by connecting lines 35. In contrast to the embodiment of FIG. 5, each of the connecting lines 35 is formed by two curves 36 and 37 which have opposite curvatures. Preferably, the curves 36 and 37 are circular arcs.

Figure 7:
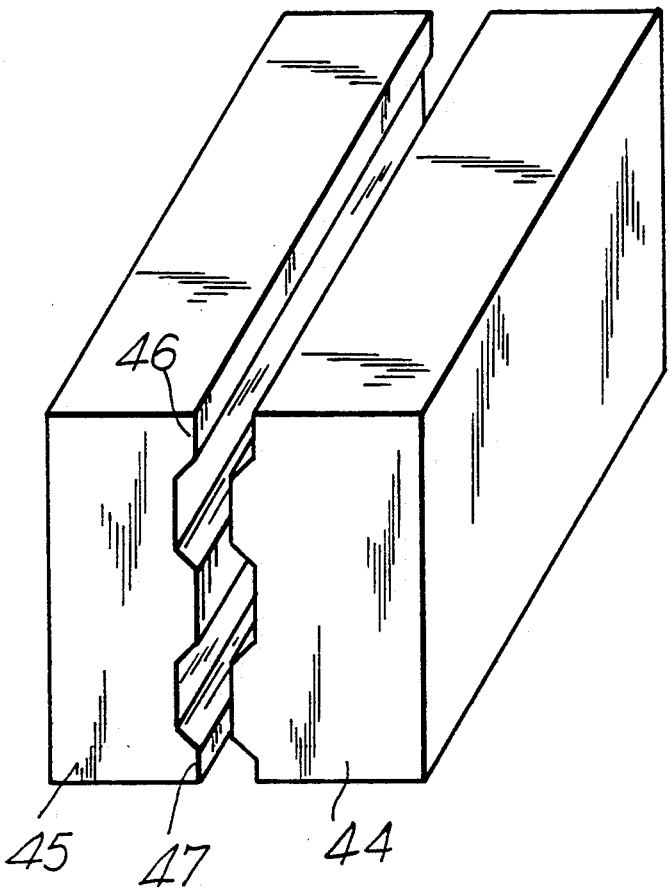
FIG. 7 is a view showing two workpieces with alternating contour mating surfaces, produced by the router tool of FIG. 6.

FIG. 7 shows two workpieces which are produced by the router tool of FIG. 6 and have mating surfaces with alternating contours. As can be seen from this Figure, workpieces 44 and 45 are routed so that their upper edges 46 and lower edges 47 are formed by the straight lines of the router tool. Therefore, no chippable, brittle feather edge is made in the workpieces. Also, the adjustment of the router tool in the vertical direction is not as critical, since the tool can be moved relative to the workpieces along a considerable vertical path only to confine the edges 46 and 47 in the region of the straight lines.

Alternating contour mating surfaces on the workpieces are produced in a known manner. A rotary router provided with a router tool in accordance with the present invention is operated so that the rotary tool is rotated about its axis, and the rotary router and the workpieces are displaced relative to one another in an axial direction and in a transverse direction to produce the mating alternating contours on the workpieces. A stepped base disclosed in our U.S. Patent can be used during this process Also, several contours of the router tool are shown on other figures of our U.S. Pat. No. 4,860,809.

It will be understood that each of the elements described above, or two or more together, may also find a useful application in other types of constructions differing from the types described above.

While the invention has been illustrated and described as embodied in a router tool for and a method of producing workpieces with alternating contour mating surfaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A router tool for producing workpieces having alternating contour mating surfaces, comprising a rotation-symmetrical working portion having an axis and an outer contour; and means for preventing edge chipping of the workpieces having alternating contour mating surfaces, said means including an axial cross-section of said working portion with said outer contour formed so that it includes a plurality of straight lines arranged in a consecutive order and each extending in a direction substantially along said axis.

2. A router tool as defined in claim 1, wherein said outer contour of said working portion is shaped so that in said axial cross-section of said working portion, said outer contour further includes a plurality of connecting lines each connecting two neighboring ones of said straight lines with one another.

3. A router tool as defined in claim 2, wherein said connecting lines of said outer contour of said working portion are straight.

4. A router tool as defined in claim 2, wherein said connecting lines of said outer contour of said working portion are curved.

5. A router tool as defined in claim 4, wherein each of said connecting lines of said outer contour of said working portion is formed by two curves having opposite curvatures and merging into one another.

6. A router tool as defined in claim 1, wherein said straight lines of said outer contour of said working portion are inclined relative to said axis in an alternating order towards said axis and away from said axis.

7. A router tool as defined in claim 1, wherein said straight lines of said outer contour of said working portion extend parallel to said axis.

8. A router tool as defined in claim 7, wherein said straight lines of said outer contour of said working portion are offset relative to one another in a direction transverse to said axis and located closer to said axis and farther from said axis in an alternating order.

9. A router tool as defined in claim 1, wherein said straight lines of said outer contour are inclined relative to said axis at an angle of substantially 20°.

10. A method of producing workpieces having alternating contour mating surfaces, comprising the steps of routing of workpieces with a routing tool having a working portion with an axis and an outer contour; and preventing edge chipping of the workpieces having alternating contour working surfaces by routing with the outer contour in an axial cross-section of said working portion, shaped so that it includes a plurality of straight lines arranged in a consecutive order and each extending in a direction substantially along said axis.

11. A router tool for producing workpieces having alternating contour mating surfaces, comprising a rotation-symmetrical working portion having an axis and a circumferentially uninterrupted outer contour; and means for preventing edge chipping of the workpieces having alternating contour mating surfaces, said means including an axial cross-section of said working portion with said outer contour formed so that it includes a plurality of straight lines arranged in a consecutive order and each extending in a direction substantially along said axis.

12. A method of producing workpieces having alternating contour mating surfaces, comprising the steps of routing of two workpieces with a routing tool having a working portion with an axis and a circumferentially uninterrupted outer contour; and preventing edge chipping of the workpieces having alternating contour working surfaces by routing with the outer contour in an axial cross-section of said working portion, shaped so that it includes a plurality of straight lines arranged in a consecutive order and each extending in a direction substantially along said axis.

* * * * *